United States Patent [19]

Rushmere

[11] 4,062,738

[45] Dec. 13, 1977

[54] ACID NICKEL ELECTROPLATING ADDITIVE THEREFOR AND METHOD OF MAKING SAID ADDITIVE

[75] Inventor: John Derek Rushmere, Wilmington, Del.

[73] Assignee: E. I. Du Pont de Nemours and Company, Wilmington, Del.

[21] Appl. No.: 690,315

[22] Filed: May 26, 1976

Related U.S. Application Data

[63] Continuation-in-part of Ser. No. 512,139, Oct. 4, 1974, abandoned, which is a continuation-in-part of Ser. No. 428,808, Dec. 27, 1973, abandoned.

[51] Int. Cl.[2] ..... C25D 3/16; C09K 3/00; C07C 143/16

[52] U.S. Cl. ..... 204/49; 204/DIG. 2; 252/182; 260/513 R

[58] Field of Search ..... 204/49, 43 T, 43 N, 204/43 P, DIG. 2; 260/513 B, 513 R; 252/182

[56] References Cited

U.S. PATENT DOCUMENTS

| | | | |
|---|---|---|---|
| 2,315,802 | 4/1943 | Lind et al. | 204/49 |
| 3,089,888 | 5/1963 | Mayhew et al. | 204/49 X |
| 3,366,557 | 1/1968 | Foulke et al. | 204/49 |
| 3,502,550 | 3/1970 | Passal | 204/49 |
| 3,699,016 | 10/1972 | Beach et al. | 204/49 |
| 3,719,568 | 3/1973 | Klein et al. | 204/49 |
| 3,795,592 | 3/1974 | Klein et al. | 204/49 |
| 3,804,727 | 4/1974 | Lyde | 204/49 |

*Primary Examiner*—G. L. Kaplan

[57] ABSTRACT

Primary brightener additives and baths and processes for acid nickel electroplating are provided, as well as a process for making such additives.

The additives contain mixtures of alkyne compounds, the major mole fractions of which consist of asymmetrical alkyne sulfonic acids.

9 Claims, No Drawings

ACID NICKEL ELECTROPLATING ADDITIVE THEREFOR AND METHOD OF MAKING SAID ADDITIVE

CROSS REFERENCE TO RELATED APPLICATIONS

This is a continuation-in-part of application Ser. No. 512,139, filed Oct. 4, 1974, now abandoned, which, in turn, is a continuation-in-part of application Ser. No. 428,808, filed Dec. 27, 1973, now abandoned, both assigned to the assignee of this application.

BACKGROUND OF THE INVENTION

This invention relates to the electroplating of bright level nickel from aqueous solutions of nickel salts. More specifically it relates to bath additives useful as primary brighteners for improving the performance of such nickel electroplating solutions, and to baths and processes using such additives.

Prior art on the electroplating of nickel from aqueous solutions of nickel salts is considerable and well documented. Nickel deposits as plated from these baths such as the chloride, sulfamate, fluoborate and the well-known Watts baths are generally dull with a matte finish and of little value for commercial application. To obtain bright, level, ductile deposits from such baths it is necessary to add various addition agents or brighteners. Brightener agents useful in nickel plating are generally divided into two general classes on the basis of their predominant function. Classes of primary and secondary brighteners are well known in the art. Primary brighteners are materials used in relatively low concentrations of about 0.01 to 0.2 g/l which by themselves may or may not produce visible brightening action. In addition, deleterious side effects such as deposit brittleness, narrow bright plate range, and skip plating at low current densities may result. Secondary brighteners are materials which are used as brighteners in combination with primary brighteners but in higher concentrations, usually of about 1 to 20 g/l. Secondary brighteners by themselves may produce some brightening action but usually only over an inadequate current density range.

When primary and secondary brighteners are carefully selected, it is possible to obtain bright, level, ductile deposits over a wide current density range.

Modern processes relate mostly to the use of the Watts bath-13 an aqueous solution of nickel sulfate, nickel chloride and boric acid used in conjunction with a suitable additive system. The additive system usually comprises, as primary brighteners, highly polar or unsaturated compounds such as pyridinium salts or acetylenic alcohols; as secondary brighteners various organic sulfonic, sulfonamide and sulfonimide compounds as disclosed in U.S. Pat. Nos. 2,191,813 (1940) and 2,466,677 (1949) issued to Henry Brown generally are used. Among the more favored secondary brighteners are saccharin and its sodium or potassium salts, sodium allyl sulfonate, naphthalene di- and tri-sulfonic acids, dibenzenesulfonimide and sodium 3-chlorobutene 1-sulfonate. Mixtures of these secondary brighteners are frequently employed. Acetylenic alcohols or their derivatives are now generally preferred as primary brighteners since they show less tendency to form brittle deposits and control of their concentration in the bath is less critical. One of the most preferred because of performance, availability and low cost in 2-butyne 1,4-diol, discussed in U.S. Pat. No. 2,712,522 issued to Otto Kardos et al. in 1955.

Use of 2-butyne 1,4-diol in conjunction with secondary brighteners of the type described above in the Watts bath yields lustrous, levellel deposits with good ductility, but there is a tendency for the formation of pitted deposits together with dark thin plate and skipped or missed plating at low current densities. To minimize these problems, derivatives of 2-butyne 1,4-diol are frequently used. Among the more favored are hydroxyalkyl derivatives obtained by the base-catalyzed addition of various epoxides to 2-butyne 1,4-diol as disclosed by Foulke et al. in U.S. Pat. No. 3,366,557 (1968). Addition of more than about 2 or 3 moles of epoxide per mole of butyne diol, while alleviating the low current density problems, tends also to result in undesirable loss of brightening or levelling ability. Similarly, acetylenic alcohols of higher molecular weight than butyne diol, while operable, are generally less effective. Symmetrical hydroxyalkyne sulfonates obtained by the acid-catalyzed reaction of acetylenic diols with epihalohydrins followed by conversion of the halide grouping to a sulfonate grouping by reaction with sodium sulfite are disclosed in U.S. Pat. No. 3,699,016 issued to Beach et al. in 1972. In conjunction with aromatic sulfur compounds as secondary brighteners these compounds give good overall performance, although there appears to be some tendency for some of them to produce a white haze at high current densities.

Consequently, it is an object of this invention to provide new compositions of matter comprising mixtures of alkyne compounds which, when used in conjunction with suitable secondary brighteners, act synergistically one upon the other to produce bright, level and ductile nickel over a wide current density range extending from high into very low current density areas.

BRIEF SUMMARY OF THE INVENTION

The present invention comprises an aqueous solution of a mixture of alkyne compounds having the general formula:

$$HR^1{}_x\text{—}R^2{}_m\text{—O—CH}_2\text{—C}\equiv\text{C—CH}_2\text{—O—}R^3{}_nH$$

wherein $$R^1 \text{ is } -O-\underset{\underset{CH_2SO_3M}{|}}{CH}-CH_2- \text{ or } -O-CH_2-\underset{\underset{CH_2SO_3M}{|}}{CH}-$$

$$R^2 \text{ is } -O-\underset{\underset{CH_3}{|}}{CH}-CH_2- \text{ or } -O-CH_2-\underset{\underset{CH_3}{|}}{CH}-$$

$$R^3 \text{ is } -\underset{\underset{CH_3}{|}}{CH}-CH_2-O- \text{ or } -CH_2-\underset{\underset{CH_3}{|}}{CH}-O-$$

$x$, $m$ and $n$ are integers such that $x = 0$ or 1

$m + n = 0$, 1 or 2

$x + m + n = 1$ or 2, and

M is hydrogen or a metal selected from sodium, potassium and nickel.

At least 50 mole percent of the mixture of alkyne compounds is asymmetrical alkyne sulfonic acid compounds, and less than 50 mole percent of the mixture is other alkyne compounds. The concentration of the alkyne compounds in the mixture is in the range of about from 0.01 millimole per liter to saturation. From about 0.1 to 2 moles per liter of the alkyne compounds is a desirable concentration for a primary brightener additive. From about 0.1 to 10.0 millimoles per liter is desirable in an electroplating bath and about 1 to 2 millimoles per liter is optimum. The concentration of alkyne compounds is readily determined from the amount of butynediol used in producing the compounds.

The additives are largely of an asymmetric nature and are prepared starting with the boron trifluoride catalyzed addition to 1 mole of 2-butyne 1,4-diol of from about 0.5 to 1.5 moles of propylene oxide followed by from about 1 to 2 moles of epichorohydrin such that the sum of the moles of propylene oxide plus the moles of epichlorohydrin added per mole of 2-butyne 1,4-diol lies between about 2.0 and 3.0, preferably about 2.5. The brown, viscous, water insoluble products so obtained are solubilized by reaction with aqueous sodium sulfite to form the mixtures of compounds which are the additives of this invention.

Because of the method of preparation, mixtures containing a variety of combinations of acetylenic compounds can be obtained. However, the significant alkyne compounds within the mixture can be described by the general formula given above. In addition, the compounds constituting the major mole fraction (at least 50 mole percent) of the mixture of alkyne compounds can be identified as the three following asymmetrical alkyne sulfonic acids:

1. 1-hydroxypropoxy, 4-sulfohydroxypropoxy 2-butyne

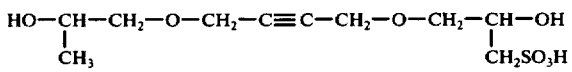

2. 1-hydroxy, 4-sulfohydroxypropoxy 2-butyne

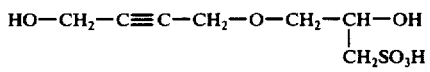

3. 1-hydroxy, 4-sulfohydroxypropoxy propoxy 2-butyne

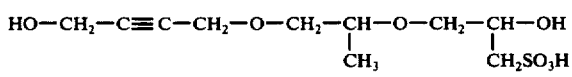

In addition to these asymmetrical alkyne sulfonic acids, a minor mole fraction (less than 50 mole percent) is made up of the following alkynols:

4. 1,4-dihydroxy 2-butyne

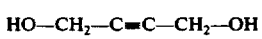

5. 1-hydroxy, 4-hydroxypropoxy 2-butyne

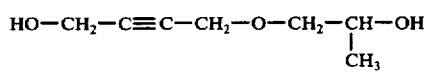

6. 1,4-di (hydroxypropoxy) 2-butyne

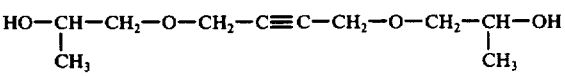

The structures given for compounds 1 to 6 are certain isomers, and it should be understood that the other isomers of the propoxy and sulfohydroxypropoxy groups in acid catalyzed reactions are also meant to be included. In discussing this subject, Kirk-Othmer's "Encyclopedia of Chemical Technology", 2nd Edition, Vol. 16, page 598, teaches that, when an epoxide such as propylene oxide adds to an alcohol of the type ROH under acid catalysis, the adduct obtained contains a mixture of both a primary alcohol,

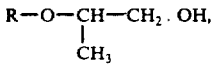

and a secondary alcohol,

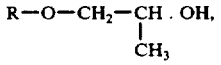

in approximately equal amounts. In contrast, according to Kirk-Othmer, when the reaction is base catalyzed, the secondary alcohol is formed almost exclusively.

Thus, using acid catalysis according to the present invention, the term "hydroxypropoxy" is used to described both of the groupings:

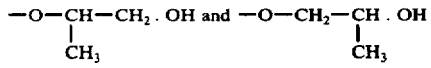

and the term "sulfohydroxypropoxy" is used to describe both of the groupings:

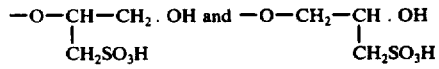

Similarly, 1-hydroxy, 4-hydroxypropoxy propoxy 2-butyne is equivalent to 1,4-di (hydroxypropoxy) 2-butyne.

A particularly desirable mixture of additives contains a mixture of alkyne compounds comprising, in mole percent, from about 5 to 50% of each of the asymmetric alkyne sulfonic acids 1-hydroxypropoxy, 4-sulfohydroxypropoxy 2-butyne; 1-hydroxy 4-sulfohydroxypropoxy 2-butyne; and 1-hydroxy, 4-sulfohydroxypropoxy propoxy 2-butyne; and about from 1 to 35% of each of the alkyne compounds 1,4-dihydroxy 2- butyne; 1-hydroxy, 4-hydroxypropoxy 2-butyne; and 1,4-di (hydroxypropoxy) 2-butyne.

The invention also comprises electroplating baths containing additives having the active constituents discussed above, electroplating processes using such baths, with current densities in the range of 1 to 1500 A/m$^2$ (0.1 to 150 A/ft$^2$), preferably 10 to 1000 A/m$^2$ (1 to 100 A/ft$^2$), and processes for making such active constituents.

DETAILED DESCRIPTION

This invention pertains to the electroplating of nickel from aqueous acidic, nickel electroplating baths known to those skilled in the art. These baths are formed by the dissolution of at least one nickel salt in aqueous, acid solution. A recent publication giving excellent coverage to the art of bright level nickel plating is "Nickel and Chromium Plating" by J. K. Dennis and T. E. Such, a Halsted Press book published by John Wiley and Sons, 1972. Operating conditions disclosed in that book including pH, temperature, current density and the concentration of bath ingredients are applicable to the present invention for use with the various types of nickel plating baths. Generally, the pH will be in the range of 3 to 5 and usually 4 to 4.5 while the temperature will be in the range of 40° to 70° C and usually 55° to 65° C.

Practically all baths for electroplating bright nickel contain nickel sulfate; a chloride, usually nickel chloride; a buffering agent, usually boric acid; and optionally a wetting agent. Such baths include the well-known Watts bath and the high chloride bath. Other baths may contain as a source of nickel other nickel salts such as nickel sulfamate, nickel fluoborate or mixtures of these salts with nickel sulfate or nickel chloride. Typical Watts baths and high chloride baths are as follows:

| | Watts | High Chloride |
|---|---|---|
| $NiSO_4 \cdot 7H_2O$ g/l | 200–400 | 40–150 |
| $NiCl_2 \cdot 6H_2O$ g/l | 30–80 | 150–300 |
| Boric Acid g/l | 30–50 | 30–50 |
| Temperature ° C | 55–65 | 55–65 |
| pH | 3–5 | 3–5 |

In practicing the present invention, the bath additives are used in conventional nickel plating baths such as the Watts and high chloride baths described above in amounts corresponding to from 0.1 millimole to 10 millimoles of combined alkynes per liter of plating bath with optimum concentrations of 0.5 to 2 millimoles per liter. The combined alkyne additives themselves conveniently have concentrations in the additive solutions in the range of 0.1 to 2 moles/liter., although other concentrations can be used. For maximum brightness, levelling action and ductility co-use of a secondary brightener or mixtures of secondary brighteners such as described above is required, preferably sulfonamides or sulfonimides and preferably in amount of from 1 to 20 g/l. From the practical aspects of cost/performance the most useful of the secondary brighteners are saccharin and the naphthalene di- and tri-sulfonic acids. In addition to these aromatic sulfur compounds, other sulfur compounds frequently known as "auxiliary secondary brighteners" such as sodium allyl sulfonate or sodium 3-chloro 2-butene 1-sulfonate may also be present in amounts of 1 to 10 g/l. Finally, it is frequently desirable that a small amount of wetting agent such as sodium ethyl hexyl sulfonate also be present in the bath to further improve the quality of the plate and to minimize pitting problems caused by gas bubbles held on the cathode surface.

The invention can be further understood by referring to the following examples.

EXAMPLE 1

0.25 mole of 2-butyne 1,4-diol was charged to a 500 ml round-bottom flask fitted with a heating mantle, stirrer, thermometer, and dropping funnel and heated to just above its melting point of 54° C. 1 ml of boron trifluoride etherate was added to the molten 2-butyne 1,4-diol, the heating mantle was then removed and 0.288 mole of propylene oxide added dropwise keeping the contents of the flask under autogenous pressure and the temperature between 50° and 60° C by means of the exothermic heat of reaction. On completion of the propylene oxide addition, 0.338 moles of epichlorohydrin was added while maintaining autogenous pressure and the temperature between 40° and 45° C. After completion of the epichlorohydrin addition, stirring was continued for 1 hour while the reaction mix cooled to room temperature. The brown, viscous, water insoluble butynediol/propylene oxide/epichlorohydrin condensation product was then solubilized by refluxing with 0.338 moles of sodium sulfite in aqueous solution to produce an aqueous addition agent having a concentration of about 0.25 moles/liter of the mixture of alkyne compounds.

In order to define more precisely the composition of the mixture of alkyne compounds so prepared, five butyne diol/propylene oxide/epichlorohydrin condensation products as formed above and prior to reaction with aqueous sodium sulfite were separated into their components by means of gas chromatography, and the individual components were further examined by means of mass spectrography to determine the molecular weight and number of contained chlorine atoms in the component compounds. The major component in the condensates was found to contain one chlorine atom per molecule and to have a molecular weight of 236 mass units corresponding to a compound containing 1 mole butyne diol/ 1 mole propylene oxide/1 mole epichlorohydrin. On reaction with aqueous sodium sulfite this compound yields 1-hydroxy, 4-sulfohydroxypropoxy 2-butyne and its isomers. Other alkyne compounds in the condensates which were identified by means of mass number and contained chlorine include a compound containing 1 mole butyne diol/1 mole epichlorohydrin and minor amounts of unreacted butyne diol and butyne diol condensed with 1 and 2 moles of propylene oxide. In only one of the five condensate samples was a minor amount of a compound with a mass weight higher than 236 mass units detected even after lengthy elution from the gas chromatographic column. This compound corresponded to butyne diol condensed with 2 moles of epichlorohydrin, but it may have been atypical of the reaction product since it was found in only one of five similar samples.

Secondary alcohols resulting from the addition of propylene oxide to butyne diol and contained in minor amounts in the mixture of alkyne compounds of the present invention are 1-hydroxy, 4-(2'-hydroxypropoxy) 2-butyne and 1,4-di (2'-hydroxypropoxy) 2-butyne; these compounds are disclosed in the above mentioned U.S. Pat. No. 3,366,557. The use of mixtures of butyne diol and butyne diol/propylene oxide condensates in nickel electroplating is disclosed by Lyde in U.S. Pat. Nos. 3,711,384 (1973) and 3,804,727 (1974); similar disclosures are made by Such et al. in German published application OLS No. 2,224,783 (1973). However the combined amounts of these alkynol compounds used within the preferred embodiments of the present invention are substantially less than the prior art deems necessary, thus illustrating the effectiveness of the asymmetric alkyne sulfonic acids comprising the major mole fraction of this invention.

The use of certain other alkyne sulfonic acids is disclosed by Brown in U.S. Pat. Nos. 2,800,442 (1957) and 2,841,602 (1958). In the latter patent, the acids disclosed are limited to those containing an unsubstituted alkane group having from 1 to 4 carbon atoms, while in U.S. Pat. No. 2,800,442 the acids disclosed are limited to those containing an aromatic aryl grouping.

EXAMPLE 2

The procedure of Example 1 was followed except that 0.376 mole of propylene oxide was reacted with 0.25 mole of 2-butyne 1,4-diol followed by further reaction with 0.25 mole of epichlorohydrin. The product so formed was solubilized by reaction with aqueous sodium sulfite to produce again an aqueous addition agent having a concentration of about 0.25 moles/liter of the mixture of alkyne compounds in water.

EXAMPLE 3

To a Watts bath containing

| | |
|---|---|
| $NiSO_4 \cdot 7H_2O$ | 300 g/l |
| $NiCl_2 \cdot 6H_2O$ | 60 g/l |
| $H_3BO_3$ | 40 g/l |
| pH | 4.5 |

were added

| | |
|---|---|
| Composition of Example 1 | 1.0 millimole/l |
| Saccharin | 2.0 g/l |
| Sodium ethyl hexyl sulfate | 0.04 g/l |

An electroplating test of this bath was conducted at 55° to 60° C in a 267 ml Hull cell using a brass cathode and agitation accomplished by means of a mechanical stirrer sweeping parallel to the cathode face. Plating was at 2 amps for 10 minutes. Prior to plating, the panel was scratched lengthwise with one pass of 600-grit emery cloth to enable a visual comparison of levelling to be made and then cleaned cathodically in commercial aqueous alkaline brass cleaner. The Hull cell test, conducted as described, gave a very bright nickel plate over the whole face of the panel. Levelling action above 120 A/m² (12 A/ft²) was very good, i.e., most of the scratches were covered. A uniform covering of semibright nickel was also deposited over the back of the panel further demonstrating the good low current density operation of this bath.

EXAMPLE 4

To a high chloride bath containing

| | |
|---|---|
| $NiSO_4 \cdot 7H_2O$ | 50 g/l |
| $NiCl_2 \cdot 6H_2O$ | 200 g/l |
| $H_3BO_3$ | 40 g/l |
| pH | 4.5 |

were added

| | |
|---|---|
| Composition of Example 2 | 1.0 millimole/l |
| Saccharin | 4.0 g/l |

A Hull cell test of this bath, plated as described in Example 3, again gave a very bright nickel plate over the whole face of the panel. Levelling action above 120 A/m² (12 A/ft²) was good, i.e., the visibility of the scratches was considerably diminished. A uniform covering of semibright nickel was also deposited over the back of the panel demonstrating good low current density operation.

EXAMPLE 5

Three liters of a bath containing

| | |
|---|---|
| $NiSO_4 \cdot 7H_2O$ | 300 g/l |
| $NiCl_2 \cdot 6H_2O$ | 60 g/l |
| $H_3BO_3$ | 40 g/l |
| Saccharin | 2 g/l |

-continued

| | |
|---|---|
| pH | 4.5 |

where prepared and heated to 55° to 60° C. A series of bent cathode plating tests were then made using increasing amounts of the additive composition of Example 1 in the tests. The bent cathodes consisted of 1⅝in. × 5 in. steel panels with a broad "V" of approximately 45° angle and 1 in. sides bent into the middle of each. Plating was at 5 amps for 30 minutes for an average current density of 450 a/m² (45 A/ft²). Prior to bending, the cathodes were scratched on both sides with one pass of 240-grit emery cloth to enable a visual comparison of levelling to be made. Only one anode was used. It faced the open V side of the cathode. Vigorous agitation of the bath was achieved by means of an air bubbler placed underneath the cathode. Table I lists the results obtained.

TABLE I

| Test No. | Amount of Additive of Example 1 Added Millimole/Liter | Results |
|---|---|---|
| 1 | 0.33 | Generally bright nickel. Good coverage all over but some dullness on edges. Good levelling on both front and back. |
| 2 | 0.66 | Bright, lustrous nickel all over. Very good to excellent levelling on front. Very good levelling on back. |
| 3 | 1.0 | Bright, lustrous nickel all over. Excellent levelling on front. Very good levelling on back. |
| 4 | 2.0 | Bright, lustrous nickel all over. Excellent levelling on front and back. |
| 5 | 4.0 | Similar to Test 4 above. |

Good levelling - considerable coverage of scratches but still visible
Very good levelling - scratches mostly covered but some scratches visible
Excellent levelling - only a few scratches visible.

What is claimed is:

1. A process for making an additive for acid nickel electroplating baths, the process comprising a. contacting about 0.5 to 1.5 moles of propylene oxide with about 1 mole of liquid 2-butyne 1,4-diol in the presence of a boron trifluoride catalyst, to produce a first reaction product;

b. contacting the first reaction product with about 1 to 2 moles of epichlorohydrin per mole of 2-butyne 1,4-diol, in the presence of a boron trifluoride catalyst, to produce a second reaction product;

the amounts of propylene oxide in (a) and epichlorohydrin in (b) being such that the total amount of propylene oxide and epichlorohydrin used is 2 to 3 moles per mole of 2-butyne 1,4-diol, and then c. contacting the second reaction product with aqueous sodium sulfite.

2. The process of claim 1 where, in step (a), the amount of propylene oxide used is 1 to 1.2 moles and the contacting is done at a temperature of 50° to 60° C, and where, in step (b), the amount of epichlorohydrin used is 1.3 to 1.5 moles and the contacting is done at a temperature of 40° to 50° C.

3. The additive produced by the process of claim 1.

4. An aqueous acid nickel electroplating bath containing, as a primary brightener, the additive of claim 3.

5. The plating bath of claim 4 additionally containing a sulfonamide, a sulfonimide, saccharin or its sodium or potassium salt, sodium allyl sulfonate, a naphthalene di- or trisulfonic acid, dibenzene sulfonimide or sodium 3-chlorobutene 1-sulfonate.

6. An aqueous electroplating bath which consists essentially of

| | |
|---|---|
| $NiSO_4 . 7H_2O$ | 150 to 400 g/l |
| $NiCl . 6H_2O$ | 40 to 150 g/l |
| $H_3BO_3$ | 20 to 50 g/l |

-continued

| | |
|---|---|
| Saccharin | 1 to 4 g/l |
| Additive of claim 3 | 0.5 to 2 millimoles/l. |

7. In the process of electroplating nickel from a bath, the improvement of using the bath of claim 4.

8. In the process of electroplating nickel from a bath, the improvement of using the bath of claim 5.

9. In the process of electroplating nickel from a bath, the improvement of using the bath of claim 6.

* * * * *